US006681846B2

(12) United States Patent
Angermann et al.

(10) Patent No.: US 6,681,846 B2
(45) Date of Patent: Jan. 27, 2004

(54) HEAT EXCHANGER

(75) Inventors: Hans-H. Angermann, Stuttgart (DE); Herbert Damsohn, Aichwald (DE); Klaus Luz, Herrenhert (DE); Conrad Pfender, Besigheim (DE)

(73) Assignee: Behr GmbH & Co., Stuttgart (DE)

( * ) Notice: Subject to any disclaimer, the term of this patent is extended or adjusted under 35 U.S.C. 154(b) by 0 days.

(21) Appl. No.: 10/285,681

(22) Filed: Nov. 1, 2002

(65) Prior Publication Data

US 2003/0098146 A1 May 29, 2003

(30) Foreign Application Priority Data

Nov. 2, 2001 (DE) ..... 101 53 877

(51) Int. Cl.[7] ..... F28F 3/00; F28F 3/08
(52) U.S. Cl. ..... 165/167; 165/166; 165/916
(58) Field of Search ..... 165/166, 167, 165/916, 78

(56) References Cited

U.S. PATENT DOCUMENTS

| | | | | |
|---|---|---|---|---|
| 2,528,013 A | * | 10/1950 | Morris | 165/167 |
| 3,783,090 A | * | 1/1974 | Andersson et al. | 165/166 |
| 4,407,359 A | * | 10/1983 | Berger et al. | 165/167 |
| 4,781,248 A | | 11/1988 | Pfeiffer | |
| 5,685,368 A | * | 11/1997 | Yuasa et al. | 165/167 |
| 5,829,517 A | * | 11/1998 | Schmid et al. | 165/167 |
| 6,318,456 B1 | | 11/2001 | Brenner et al. | |
| 6,340,054 B1 | * | 1/2002 | Schwarz et al. | 165/167 |

FOREIGN PATENT DOCUMENTS

| | | |
|---|---|---|
| DE | 36 22 316 C1 | 1/1988 |
| DE | 41 25 222 A1 | 2/1992 |
| DE | 693 16 121 T2 | 4/1998 |
| DE | 197 09 671 A1 | 9/1998 |
| DE | 694 11 007 T2 | 10/1998 |
| DE | 198 15 218 A1 | 10/1999 |
| DE | 199 09 881 A1 | 9/2000 |
| EP | 0 623 798 B1 | 11/1994 |
| EP | 0 588 117 B1 | 1/1998 |
| EP | 0 551 545 B1 | 7/1998 |
| GB | 2 278 430 A | 11/1994 |

* cited by examiner

*Primary Examiner*—Henry Bennett
*Assistant Examiner*—Tho Duong
(74) *Attorney, Agent, or Firm*—Foley & Lardner

(57) ABSTRACT

The invention relates to a heat exchanger, particularly of cross-current design, through which at least two separate media can flow. It comprises plates which are stacked on one another and which are spaced apart from one another in some areas and are in contact with one another in other areas, so that flow paths are formed between respectively adjacent plates in a heat exchange region. The plates have apertures adjacent to the heat exchange region, and the plates are spaced apart from one another by means of shaped-out portions of the plates. Areas succeeding one another about the circumference of the plates have apertures, and these areas are alternately shaped out in opposite directions from the plane of the plates.

16 Claims, 4 Drawing Sheets

HEAT EXCHANGER

CROSS-REFERENCE TO RELATED PATENT APPLICATIONS

The right of priority is claimed based on Federal Republic of Germany Application 101 53 877.4, filed Nov. 2, 2001, the entire content of which, including the specification, drawings, claims and abstract, is incorporated herein by reference.

BACKGROUND OF THE INVENTION

The present invention relates to a heat exchanger, particularly of cross-current design, through which at least two separate media can flow. The invention particularly relates to a plate-type heat exchanger.

Heat exchangers of the generic type are known from, for example, DE 199 09 881 A1. This known heat exchanger has plates which are stacked on one another and which are spaced apart from one another in some areas and are in contact with one another in other areas. By this means, a flow path for a medium, for example, a fluid, is formed between respectively adjacent plates in a heat exchange region. So that the plates can be arranged spaced apart from one another, bosses and/or beads are formed on them.

Adjacent to the heat exchange regions, the plates further comprise inlet duct apertures and outlet duct apertures. The heat exchanger is formed by a layered sandwich-like arrangement of the plates. The plates are in this case rotated 90° relative to one another—with respect to a center axis of the plates—so that flow ducts which are sealed off from one another are formed. To achieve sealing of the flow ducts, the plates are brazed at the bosses and/or beads bearing on one another. A disadvantage of this is that it entails a considerable manufacturing outlay. In addition, even slight height tolerances of the beads and/or bosses lead to a gap formation, and this can be compensated, by brazing, only with considerable extra outlay or, in extreme cases, cannot be compensated at all.

EP 0 623 798 B1 discloses a plate heat exchanger in which trough-shaped heat exchanger plates are stacked one inside the other. Turbulence inserts can be arranged between the heat exchanger plates to form flow ducts. The heat exchanger plates can be brazed to one another in their circumferential edge areas. Additional sealing washers are provided to form the flow paths sealed off from one another. In addition to increased consumption of material, this also results in a considerable outlay in manufacturing terms.

SUMMARY OF THE INVENTION

One object of the invention is to make available a heat exchanger of the generic type which is distinguished by a simple design and, consequently, lends itself to straightforward production.

In accordance with one aspect of the present invention, there has been provided a heat exchanger for thermal exchange between at least two separate media comprising a plurality of plates stacked on one another, with first areas which are spaced apart from one another and second areas which are in contact with one another to form respective first and second flow paths between respectively adjacent plates in a generally planar heat exchange region. Each of the plates comprises a plurality of outer regions each containing an aperture adjacent to the heat exchange region, and the plates are spaced apart from one another by means of shaped-out portions of the plates. Outer regions, which succeed one another about the circumference of the plates and which contain the apertures, are alternately shaped-out in opposite directions from the plane of the heat exchange region.

Further objects, features and advantages of the present invention will become apparent from the detailed description of preferred embodiments that follows, when considered together with the accompanying figures of drawing.

DETAILED DESCRIPTION OF THE PREFERRED EMBODIMENTS

By virtue of the fact that areas which succeed one another about the circumference of the plates, and which each have apertures, are alternately shaped out in opposite directions from the plane of the plates, it is readily possible, by stacking plates of this type on one another, to form heat exchangers with adjacent flow paths sealed off from one another. Those areas of adjacent plates which are alternately shaped out from the plane of the plates come into bearing contact when the plates are stacked on one another and thus, on the one hand, define the shape of the flow paths between the plates and, on the other hand, at the same time serve to seal off adjacent flow paths. Because, in particular, the alternately shaped-out areas have a relatively large surface area, a large support surface is at the same time obtained between the adjacent plates. Thus, a heat exchanger comprising these plates has great stability. At the same time, this simplifies the tight connection of the adjacent plates. In particular, therefore, manufacturing tolerances and/or assembly tolerances cannot result in the formation of a gap between adjacent plates.

In one preferred embodiment of the invention, the plates are of pot-shaped or dish-shaped design, with an edge extending from a base. The edge preferably extends conically or essentially conically to the base. By this means, it is advantageously possible to arrange the plates one above the other with self-adjustment to complete the heat exchanger. Moreover, this results in a minimal gap geometry between adjacent plates, so that these can be joined together particularly easily and safely in a pressure-tight manner.

In a further preferred embodiment of the invention, the areas with the apertures merge into the heat exchange region via steps. These steps preferably extend substantially perpendicular to the heat exchange region. Such plates forming the heat exchanger are particularly easy to produce in one piece as a result of their simple geometry. Furthermore, the desired spacing of the adjacent plates relative to one another can be determined by the height of the steps.

Furthermore, in a preferred embodiment of the invention, apertures lying diametrically opposite one another are the same size. In the case of plates arranged one above the other, an upper aperture is preferably made larger, by twice the material thickness, than a lower aperture. It is further preferably provided that the apertures are each encircled by a circumferential bead or rim. By this means, the plates can be joined together very advantageously in a pressure-tight manner in order to form flow paths which are sealed off from one another. By means of the circumferential beads or rims, a minimal gap geometry between adjacent plates is obtained, and this gap geometry can be easily closed off in a pressure-tight manner, e.g., by brazing.

Figures 1, 2, 3:
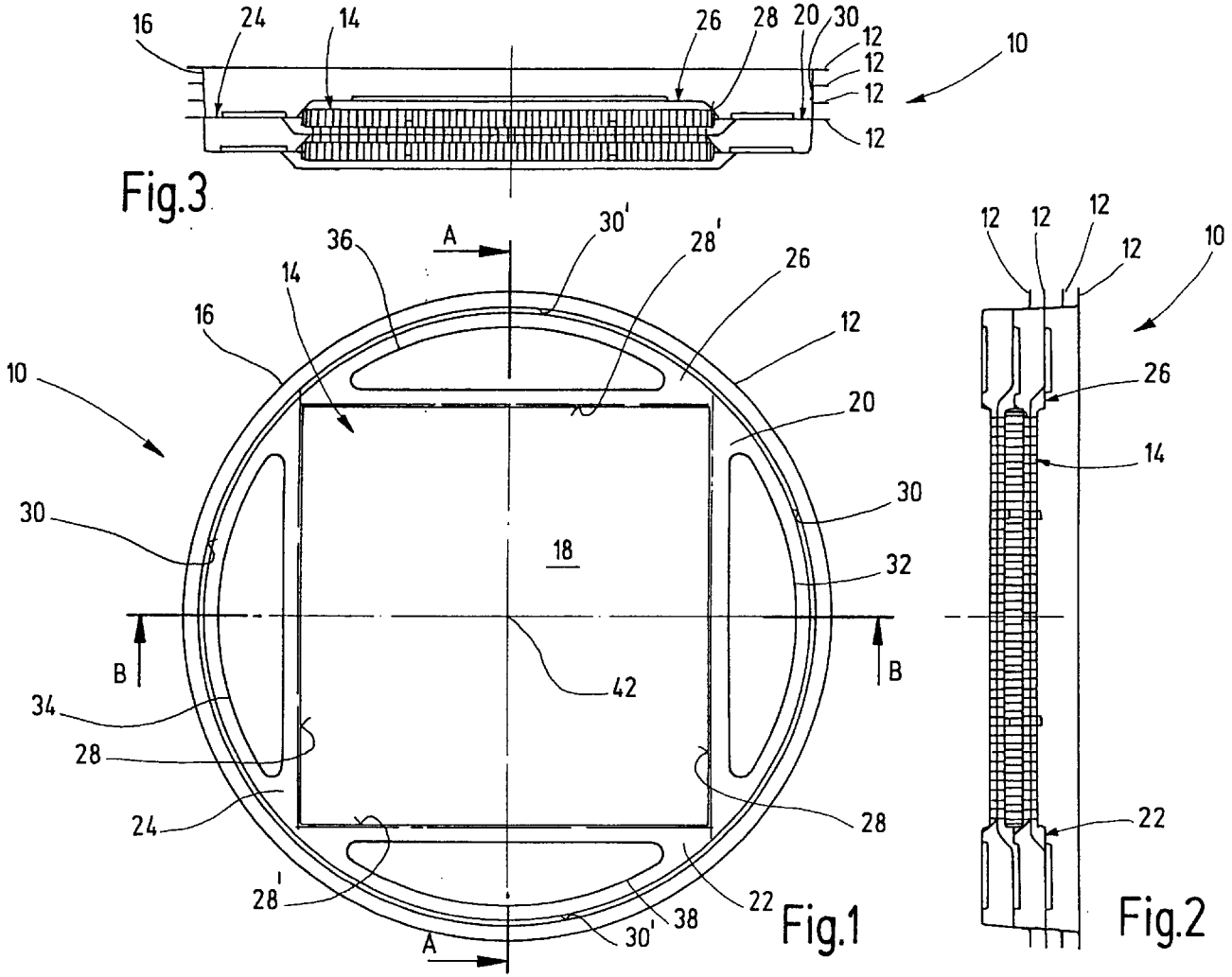
FIG. 1 is a plan view of a plate of a heat exchanger.
FIG. 2 is a cross sectional view, taken, along line A—A in FIG. 1, through an arrangement of four plates stacked on top of one another.
FIG. 3 is a cross sectional view taken, along section line B—B in FIG. 1, through four plates stacked on top of one another.

FIG. 1 is a plan view of a heat exchanger designated overall by 10. FIG. 2 is a longitudinal section along line A—A through the heat exchanger 10, while FIG. 3 is a longitudinal section along line B—B through the heat exchanger 10. In the views in FIGS. 1, 2 and 3, the cover plate and connector plate to be discussed later are not shown.

The heat exchanger 10 consists of plates 12 stacked on one another. According to the illustrative embodiment shown, four plates 12 are provided, but it will be clear that the number of plates 12 can be smaller or greater depending on the demands of the heat exchanger 10.

The design of the plates 12 will be explained with reference to the plan view of the upper plate 12 of the heat exchanger 10 in FIG. 1. The plate 12 is substantially disk-shaped and has a base 14 encircled by a projecting edge 16. This results in a pot-shaped or dish-shaped configuration of the plates 12, which will become clear in the sectional views. The base 14 forms a heat exchange region 18 which is surrounded by areas 20, 22, 24 and 26. The areas 20, 22, 24 and 26 are arranged in clockwise direction around the heat exchange region 18 and thus, on the one hand, adjoin the heat exchange region 18 via inner edges 28 and, on the other hand, adjoin the edge 16 via outer edges 30. To better illustrate the design of the plates which will be explained below, the inner edges assigned to the areas 20 and 24 are designated by 28 and their outer edges by 30, and the inner edges assigned to the areas 22 and 26 are designated by 28' and their outer edges by 30'.

The heat exchange region 18 coincides with the plane of the base 14 of the plate 12. In the diagrammatic view in FIG. 1, it is assumed that the heat exchange region 18 lies in the plane of the paper. The opposite areas 20 and 24 are shaped in such a way that they lie below the plane of the heat exchange region 18, while the opposite areas 22 and 26 are shaped in such a way that they lie above the plane of the heat exchange region 18. The inner edges 28, 28' thus, as it were, form a step via which the areas 20, 22, 24, 26 merge into the heat exchange region 18. As the sectional views illustrate, the inner edges 28, 28' are in this case substantially perpendicular to the plane of the heat exchange region 18. The area 24 has an aperture 34, while the area 20 has an aperture 32. Analogously, the area 26 has an aperture 36, and the area 22 has an aperture 38. The apertures 32, 34, 36 and 38 have a substantially oval shape in this embodiment which is flattened in each case on the side facing the heat exchange region 18. The apertures 32 and 34 have the same size, and the apertures 36 and 38 likewise have the same size. The apertures 32 and 34 are in this case larger than the apertures 36 and 38, and, preferably, specifically by an amount equal to a doubled material thickness of the plate 12. This aspect will be discussed further with reference to FIG. 4.

The apertures 32, 34, 36, 38 are each encircled by a circumferential bead or rim 40 (FIG. 4), each of which, according to the view in FIG. 1, protrudes upwardly.

The design, function and assembly of the heat exchanger 10 will be explained in more detail with reference to the enlarged view in FIG. 4.

Figure 4:
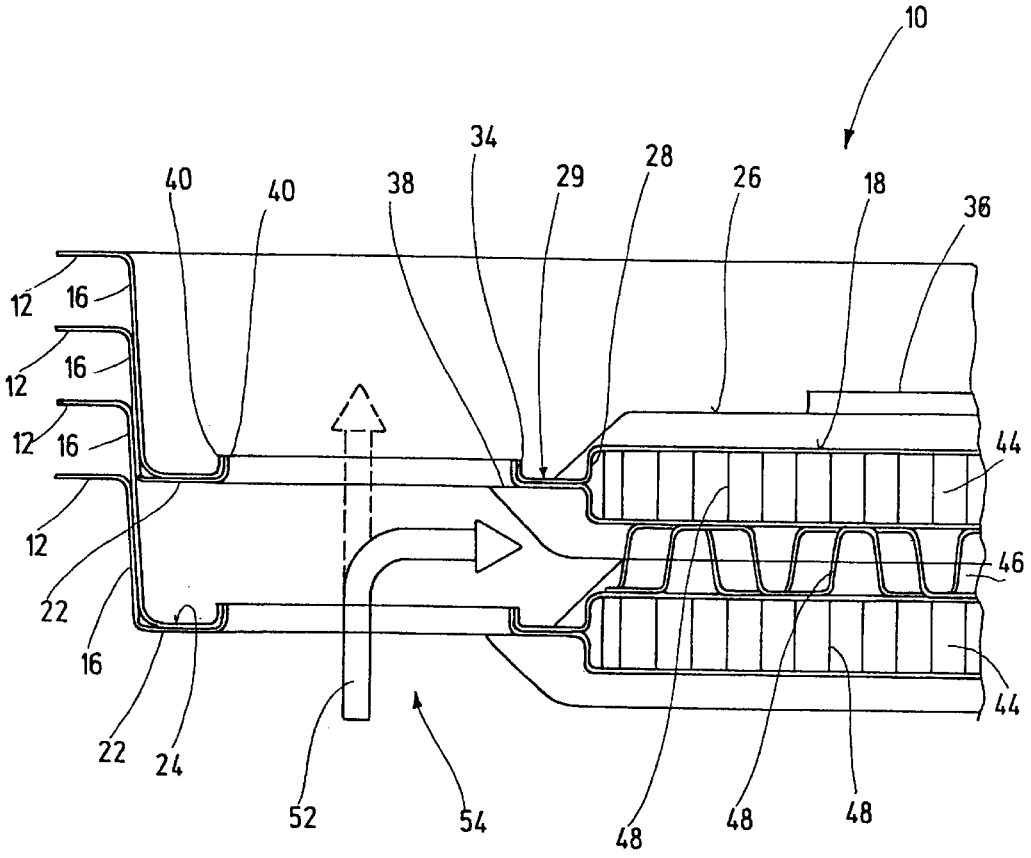
FIG. 4 shows an enlarged detail of the edge region of the four stacked plates.

Four plates 12 stacked on top of one another are shown in the detailed partial view in FIG. 4. It is clear that the plates 12 each engage in one another via their edges 16. The edges 16 are designed conically so that self-adjusting stacking of the plates 12 is possible. When stacking the plates 12, every other plate is rotated through 90° in relation to the view in FIG. 1. In this way, the heat exchanger 10 can be realized using structurally similar plates 12. By means of the arrangement of the plates 12 rotated through 90° relative to an imaginary center axis 42 (FIG. 1), an area 24 of the uppermost plate 12 comes to lie on an area 22 of the plate 12 arranged underneath. Analogously, the area 26 of the uppermost plate 12 comes to lie on an area 24 (not shown) of the plate 12 following underneath. This arrangement continues about the circumference of the plates 12.

Since the areas 20, 22, 24, 26 are alternately shaped out in opposite directions from the plane of the plates 12, this means that, with areas 20, 22, 24 and 26 lying on one another, the heat exchange regions 18 of two adjacent plates 12 are spaced apart from one another, to form flow paths 44, 46, respectively. A large number of flow paths 44, 46, respectively, are thus obtained depending on the number of plates 12. The flow paths 44 and 46 are sealed off from one another, whereas the flow paths 44 themselves communicate with one another, and the flow paths 46 themselves communicate with one another, via the apertures 32, 34, 36 and 38, respectively, depending on the arrangement of the plates 12. In this way, the flow paths 44 and 46 can be traversed by separate media, for example, fluids. In the illustrative embodiment shown, the flow paths 44 and 46 are arranged in such a way that the directions of media flowing through them cross, so that a cross-current heat exchanger is realized. Turbulence elements 48 (indicated here), for example, turbulence vanes can be advantageously arranged in the flow paths 44, 46, respectively, and lead to a swirling movement of the medium flowing through and, consequently, to a good heat exchange via the heat exchange regions 18. The arrangement and function of the turbulence elements 48 and of the heat exchange between the flow paths 44 and 46 are generally known, so that these will not be discussed in any further detail within the context of the present description.

From the view in FIG. 4, it will be clear that, when the plates 12 are stacked on one another, the circumferential beads or rims 40 of the apertures 32, 34, 36, 38, respectively, engage in one another, depending on the arrangement of the plates 12. This is made possible by the fact that the apertures 32 and 34 are made larger, e.g., by double the material thickness of the plates 12, than the apertures 36 and 38.

In this way, the beads or rims 40 of the lower plates 12 engage with a form fit in the beads or rims 40 of the upper plates 12. Analogously, the edge 16 of the upper plates 12 engages in the edge 16 of the lower plates 12, likewise with a form fit. Thus, in order to produce a pressure-tight arrangement, the plates 12 lying on one another only have to be joined together in the area of the edges 16 or in the area of the beads or rims 40. This can be done by methods known per se, for example, adhesive bonding, brazing, laser welding, or other suitable methods. These are chosen in particular depending on the material properties of the plates 12. The turbulence elements 48 inserted between the heat exchange regions 18 can be fixed at the same time, during this joining-together of the plates 12, without these members necessarily having to be additionally joined to the plates 12. For adjustment during assembly, provision can be made for the plates 12 to have, in the area of the heat exchange regions 18, at least one boss or preferably two bosses 50 (FIGS. 5*a* and 5*b*) into which the profiled shape of the turbulence elements 48 engages with a form fit. Other shapes can obviously be employed, or any other type of registering means.

The direction of flow of a medium 52 is also indicated in FIG. 4. This medium is directed to the heat exchanger 10 via the connector plate (not shown in FIG. 4). Depending on the arrangement of the plates 12, this results in two separate flow paths which each have an inlet and each have an outlet. The inlet 54 of one flow path is shown in FIG. 4. This is formed by the superposed arrangement of the apertures 34 and 38 of the plates 12. The medium 52 flowing into the inlet 54 thus comes into the flow path or flow paths 46. The second medium (not shown in FIG. 4) is guided through the flow paths 44 in an analogous manner. The media are guided through the heat exchanger 10 in a manner generally familiar to the skilled person, so that this aspect is not dealt with in detail here.

Referring to FIG. 4, it will thus be clear that, in order to obtain the flow paths 44 and 46 sealed off in a pressure-tight manner from one another, the structurally similar plates 12 are simply placed over one another, respectively rotated through 90°, and are joined together at the edges 16 and the circumferential beads or rims 40. By means of the at least partial mutual engagement of the edges 16 or the circumferential beads or rims 40 of the plates 12, minimal gaps are obtained between the plates 12 so that, even in the event of manufacturing tolerances of the heat exchanger 10, for example, by varying heights of the turbulence inserts 48, a minimal gap geometry is guaranteed in each case. This can be closed off in a simple manner using known joining methods.

Figure 5B:
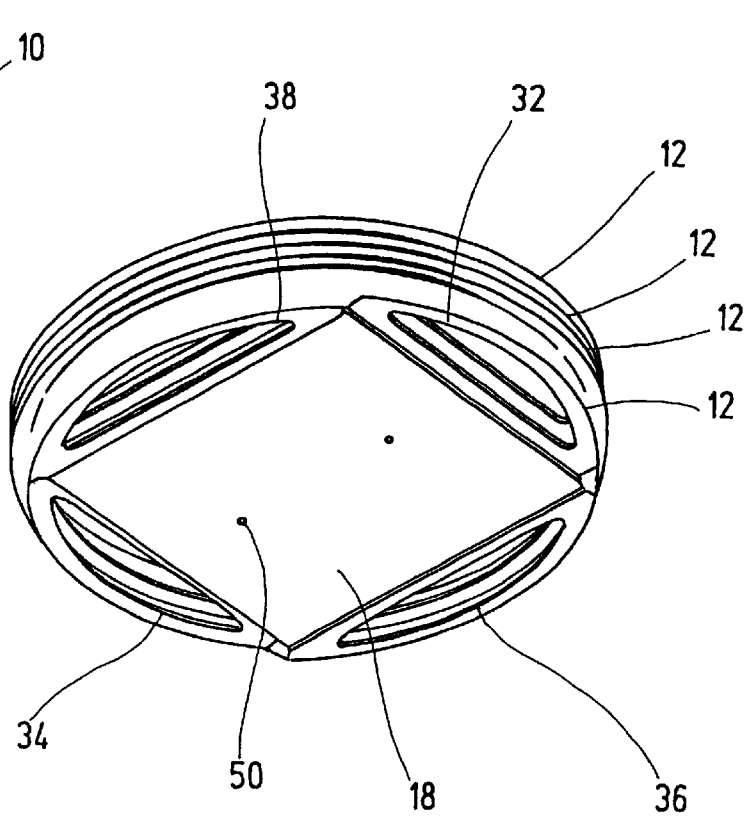
FIGS. 5*a,* 5*b* are perspective views of the stacked plates.
Figure 5A:
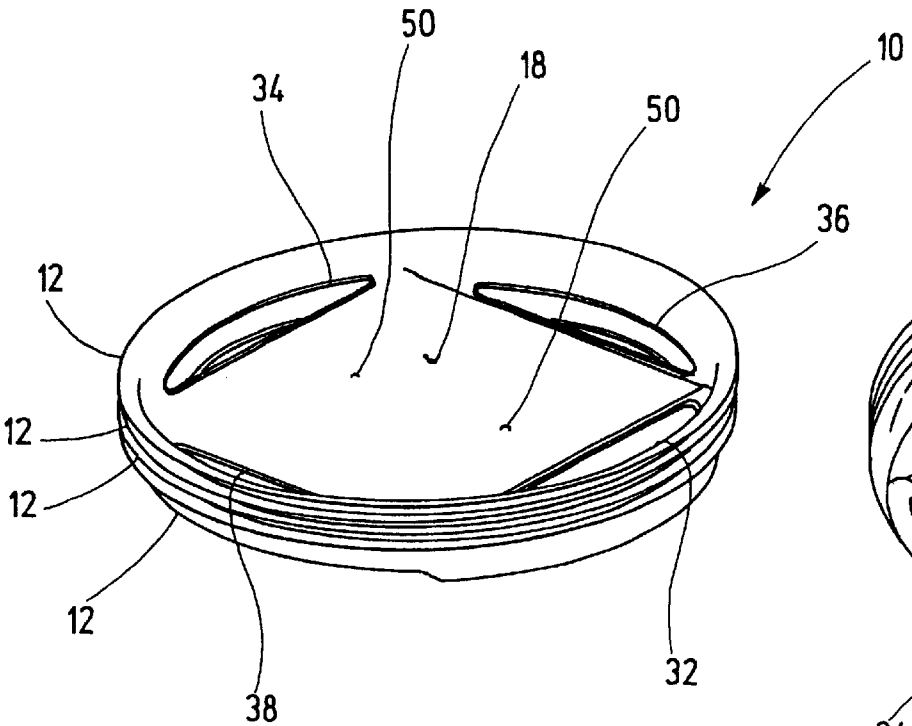

The four plates 12 stacked on top of one another are once again shown diagrammatically in FIGS. 5*a* and 5*b*. It will be clear from this perspective view that a very compact structure of the heat exchanger 10 can be obtained by means of the stacking of the plates 12.

Figure 6B:
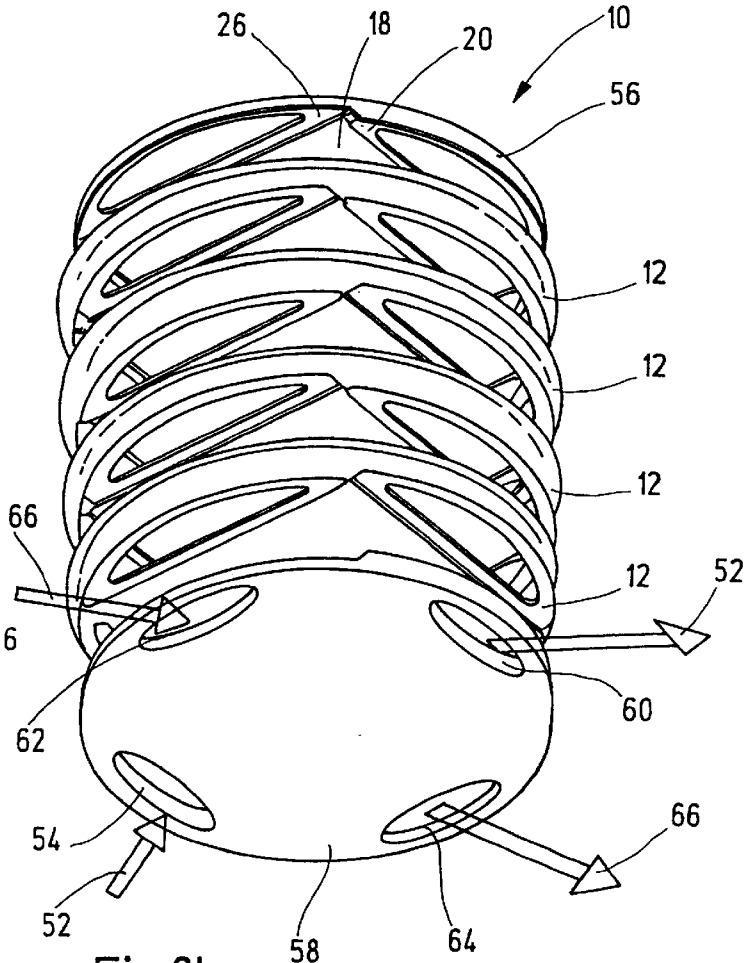
FIGS. 6*a,* 6*b* are perspective views of a heat exchanger in an exploded view.
Figure 6A:
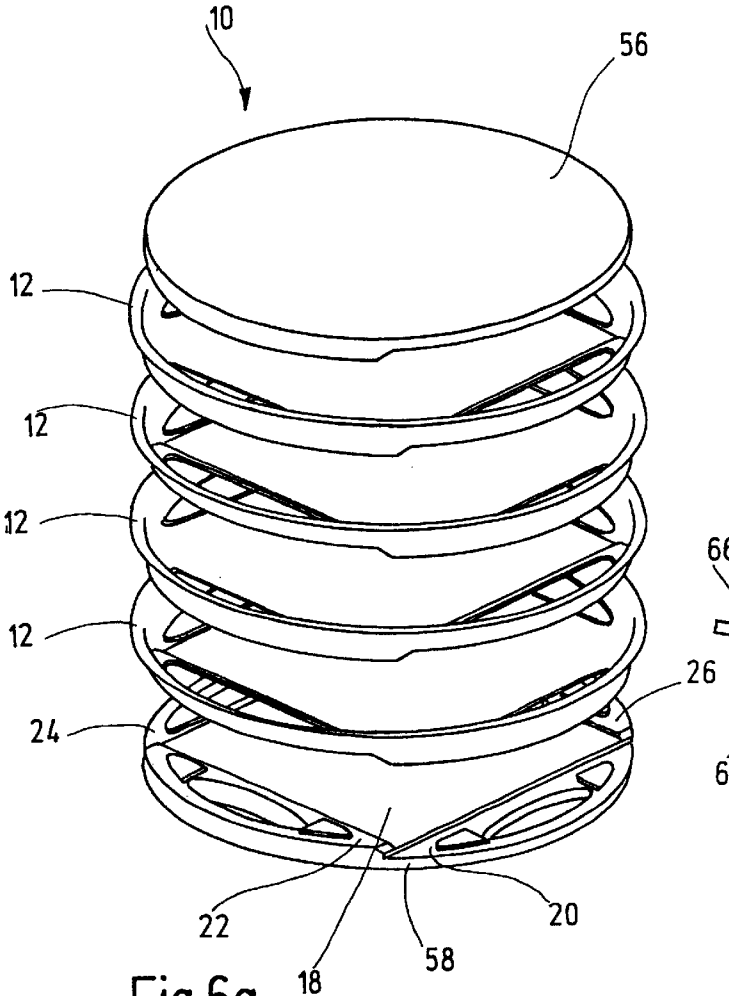

In FIGS. 6*a* and 6*b,* the heat exchanger 10 is shown in each case in a diagrammatic exploded view. In addition to the plates 12, a cover plate 56 and a connector plate 58 are shown here. On their sides facing toward the plates 12, the cover plate 56 and connector plate 58 have a structure corresponding to the plates 12, that is to say the areas 20, 22, 24 and 26 here are also offset in the plane to form a heat exchange region 18. This permits a tight closure of the apertures 30, 32, 34, 36 in the area of the cover plate 56, and, in the area of the connector plate 58, permits the delivery of the respective media between which the heat exchange is intended to take place.

The cover plate 56 is closed to the outside, whereas the connector plate 58 has the inlets and outlets for the flow paths. The figure shows the inlet 54 and an outlet 60 for the medium 52, and an inlet 62 and an outlet 64 for a medium 66.

The plates 12, 56 and 58 and the turbulence inserts 48 can be made of metal, for example, aluminum, copper, stainless steel and/or of plastic. The choice of material will depend in particular on its resistance to the media 52 and 66 that flow through the heat exchanger 10. A typical wall thickness of the plates 12 is, for example, between 0.1 and 1 mm. A typical height of the turbulence inserts 48 can be, for example, between 1 and 10 mm.

The configuration of the particular embodiment illustrated in FIGS. 1 through 6 is given only by way of example. Thus, instead of a circular design, the plates 12, 56 and 58 can be provided with an oval or rectangular, e.g., square, design. Moreover, by suitable configuration of the areas which have the apertures and which are provided about the circumference of the plates, a heat exchanger can be formed with more than two inlets 54, 62 and more than two outlets 60, 64.

The heat exchanger 10 can be used, for example, as a condenser, in order to condense water out of humid air, without this water entraining ions from a condenser material. A further possible use of the heat exchanger 10 is in a gas generator system of a fuel-cell-powered vehicle, for which purpose the heat exchanger 10 is designed as a chemical reactor in which every other flow path is provided as a reaction channel with a catalyst lining, and the remaining flow paths serve for cooling or heating the reaction chambers. The use as a catalytic reactor is also possible. Moreover, use as an oil cooler or fuel cooler is also possible.

The foregoing description of preferred embodiments of the invention has been presented for purposes of illustration and description only. It is not intended to be exhaustive or to limit the invention to the precise form disclosed, and modifications and variations are possible and/or would be apparent in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto and that the claims encompass all embodiments of the invention, including the disclosed embodiments and their equivalents.

What is claimed is:

1. A heat exchanger for thermal exchange between at least two separate media comprising:

a plurality of plates stacked on one another, with first areas which are spaced apart from one another and second areas which are in contact with one another to form respective first and second flow paths between respectively adjacent plates in a generally planar heat exchange region, wherein each of the plates comprises a plurality of outer regions each containing an aperture adjacent to the heat exchange region, and the plates are spaced apart from one another by means of shaped-out portions of the plates, and wherein outer regions, which succeed one another about the circumference of the plates and which contain the apertures, are alternately shaped-out in opposite directions from the plane of the heat exchange region.

2. A heat exchanger as claimed in claim 1, wherein the plates comprise an edge extending from a base.

3. A heat exchanger as claimed in claim 2, wherein the base forms the heat exchange region.

4. A heat exchanger as claimed in claim 1, wherein the outer regions merge into the heat exchange region via steps.

5. A heat exchanger as claimed in claim 4, wherein the steps extend substantially perpendicularly to the heat exchange region.

6. A heat exchanger as claimed in claim 4, wherein adjacent steps and thus circumferentially adjacent areas protrude in opposite directions from the heat exchange region.

7. A heat exchanger as claimed in claim 1, wherein apertures lying diametrically opposite one another in relation to a center axis of the plates comprise first apertures and are the same size.

8. A heat exchanger as claimed in claim 7, wherein apertures circumferentially adjacent to the first apertures comprise second apertures, which are larger than the first apertures by an amount equal to double the material thickness of the plate.

9. A heat exchanger as claimed in claim 1, wherein each aperture is encircled by a circumferential rim.

10. A heat exchanger as claimed in claim 1, wherein each aperture has a substantially oval shape.

11. A heat exchanger as claimed in claim 2, wherein the edges of the plates extend essentially conically to the base.

12. A heat exchanger as claimed in claim 1, further comprising turbulence elements arranged between adjacent plates.

13. A heat exchanger as claimed in claim 12, wherein the plates have, in their heat exchange region, at least one structure for positioning of the turbulence elements.

14. A heat exchanger as claimed in claim 1, wherein the heat exchanger further comprises a cover plate and a connector plate between which the stacked plates are arranged.

15. A heat exchanger as claimed in claim 14, wherein the cover plate and the connector plate, on their sides facing the plates, have a configuration corresponding to the plates.

16. A heat exchanger as claimed in claim 1, wherein the plates are comprised of metal and are brazed together.

* * * * *